United States Patent [19]

Hampton et al.

[11] 4,220,302

[45] Sep. 2, 1980

[54] NURSING BOTTLE HOLDER

[76] Inventors: Jarold L. Hampton; Diane M. Hampton, both of 1104 S. Ivy, Nampa, Id. 83651

[21] Appl. No.: 926,840

[22] Filed: Jul. 21, 1978

[51] Int. Cl.[2] ..... A47D 15/00

[52] U.S. Cl. ..... 248/102; 24/204; 224/148; 244/205; 244/901

[58] Field of Search ..... 248/102; 224/5 R, 5 BC, 224/5 W, 148, 205, 901; 2/DIG. 6; 24/204

[56] References Cited

U.S. PATENT DOCUMENTS

| | | | |
|---|---|---|---|
| 3,099,884 | 8/1963 | Kixmiller et al. | 24/204 X |
| 3,387,341 | 6/1968 | Mates et al. | 24/204 X |
| 3,850,393 | 11/1974 | Marquard | 248/102 |
| 3,931,917 | 7/1976 | Zellmer | 224/205 |
| 4,051,554 | 10/1977 | Kallman | 2/DIG. 6 |
| 4,055,873 | 11/1977 | Kallman | 2/DIG. 6 |
| 4,096,977 | 6/1978 | Barville | 248/102 X |

OTHER PUBLICATIONS

Strapet, an advertising brochure published by Kallman Research Corporation, Brooklyn, New York.

*Primary Examiner*—William H. Schultz
*Attorney, Agent, or Firm*—Paul F. Horton

[57] ABSTRACT

A nursing bottle holder comprising a shoulder strap having a Velcro pad disposed on the front vertical surface thereof and a bottle strap having a complimentary Velcro pad disposed on the outer surface thereof, the Velcro pads being temporarily engageable to hold the nursing bottle in a selected vertically planar position. The shoulder strap and bottle strap may also each be provided with Velcro strips on opposing ends and surfaces thereof, respectively for adjusting the shoulder strap about the body and the bottle strap about bottles of varying diameters.

4 Claims, 9 Drawing Figures

NURSING BOTTLE HOLDER

BACKGROUND OF THE INVENTION

1. Field of the Invention

This invention relates, in general, to nursing bottle holders, and in particular, to nursing bottles holders having means for rotating the bottle in a vertical plane about a horizontal axis.

2. Description of the Prior Art

The advantages inherent in a body supported nursing bottle holder have long been recognized. Many types of supports have been devised over the years to provide comfortable feeding for the infant while freeing at least one hand of the person holding the infant. Generally, such devices, as typified by Brooks U.S. Pat. No. 3,144,230 and Woodard, U.S. Pat. No. 3,977,638, include a strap for encircling the neck and adjustment means utilizing buckles, buttons, or snaps for lengthening the neck strap to provide proper elevation of the bottle. Such devices also commonly include hooks, clamps, and elastic bands for holding the bottle. To provide proper tilt to the bottle, pivoting hooks and suspension loops as typified by Dyer, U.S. Pat. No. 2,764,376 and Brooks, respectively, have been devised. More recently, bottle clamps pivoting about a central rivet to provide proper tilt have been used, as shown by U.S. Pat. No. 3,365,153 issued to Baucom and U.S. Pat. No. 3,850,393 issued to Marquard.

Prior art nursing bottle holders have invariably included buttons, snaps, rivets, bars, hooks, and other hard, rigid, and sharp objects which can and many times have resulted in accidental injury to the face and eyes of the infant. Furthermore, such objects may rust or break and often prevent adequate cleaning of the bottle holding apparatus resulting in unsanitary conditions which may also impair the health of the infant. Additionally, such objects are often large, ungainly, and expensive, resulting in their non-use.

SUMMARY OF THE INVENTION

The present invention comprises, generally, a body-supported nursing bottle holder including a shoulder strap and a bottle strap adjustable to the diameter of a bottle. Both shoulder strap and bottle strap include a pair of Velcro pads, connectable to one another, disposed on opposing ends and surfaces of the straps. Additionally, the shoulder strap has a Velcro pad on its front, exterior surface, which is connectable to a second Velcro pad disposed on the outer surface of the bottle strap. A more comprehensive understanding of the invention may be had by reading the claims appended hereto.

It is therefore a general object of the present invention to provided a baby bottle holder which is made completely of fabric, which is compact, and which is inexpensive.

It is also an object of the present invention to provide a baby bottle holder which is flexible in its entirety, having no rigid or hard objects mounted thereon.

It is a further object of the present invention to provide a baby bottle holder having a shoulder strap forming a loop which may be simply rotated on a person to provide proper bottle height.

A still further object of the present invention is to provide a baby bottle holder including a shoulder strap and a bottle strap in which the bottle strap is detachably connectable to the shoulder strap in a variety of rotatable positions to provide proper tilt to the bottle.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
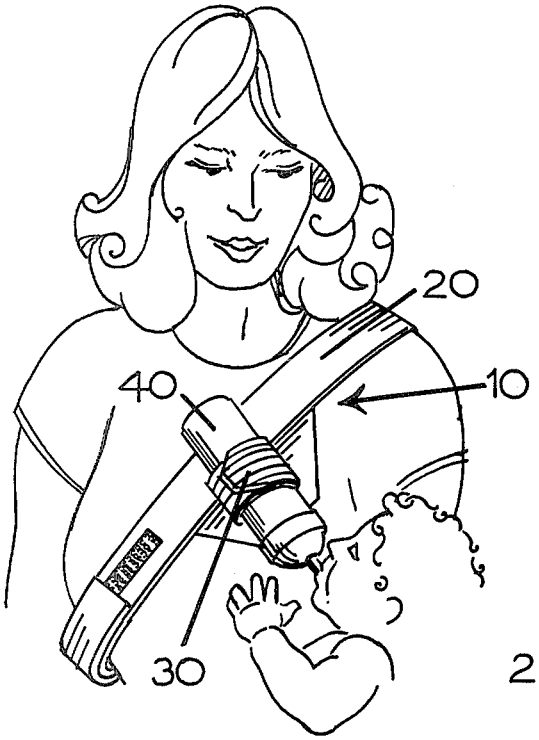
FIG. 1 is a perspective view of the nursing bottle holder of the present invention, as shown in use.
Figure 2:
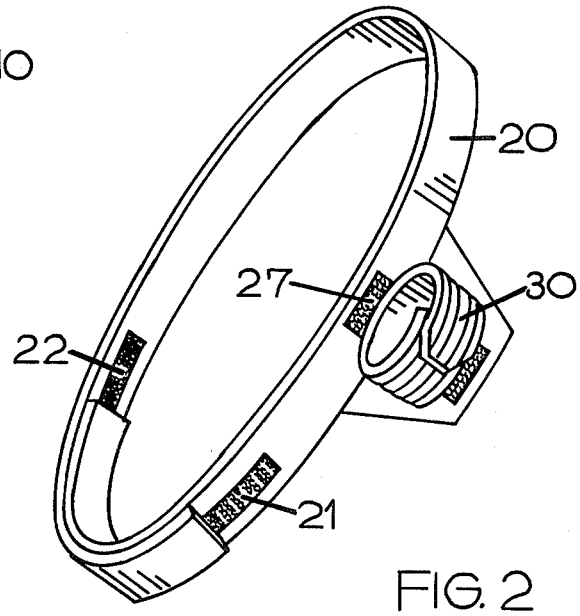
FIG. 2 is a perspective view of the nursing bottle holder of the present invention.

Referring now to the drawings, and, more particularly, to FIG. 1, an embodiment to be preferred of a nursing bottle holder 10, made according to the present invention is disclosed. Bottle holder 10 includes a shoulder strap 20 and a bottle strap 30.

Figure 3:
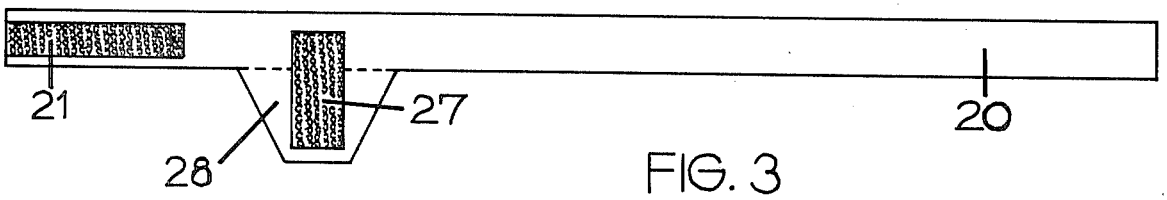
FIG. 3 is a front view of the shoulder strap of the present invention.
Figure 4:
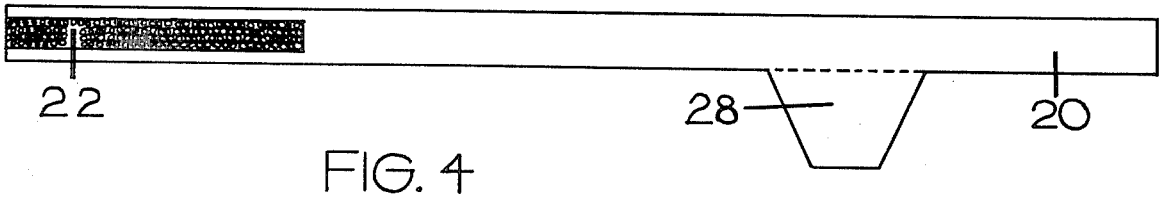
FIG. 4 is a back view of the shoulder strap of the present invention.
Figure 9:
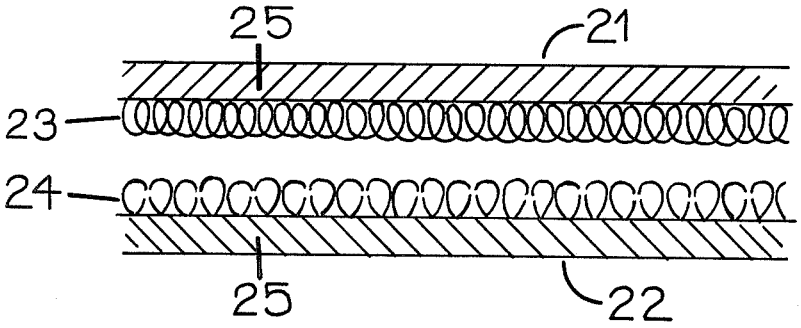
FIG. 9 is a fragmentary side view of the connector strips of the shoulder strap of the present invention.

Shoulder strap 20 may be of unitary construction and may be made of any fabric, as for example cotton, linen, nylon, or flexible plastics. As shown to advantage in FIGS. 3 and 4, the shoulder strap is provided with a pair of connector strips 21 and 22, each strip being attached on opposing planar surfaces and adjacent opposing ends of the strap in longitudinal orientation therewith. Connector strips 21 and 22 may be made of any suitable material which securely but temporarily engage one another, as for example adhesive strips. In the preferred embodiment however, connector strips 21 and 22 include a base member 25 made of any suitable fabric having a multiplicity of plastic connectors transversely and outwardly extending thereupon. The plastic connectors may take the form of a multiplicity of plastic loops 23 or a multiplicity of plastic hooks 24, shown to advantage in FIG. 9. It will be seen that as connector strips 21 and 22 are pressed together that hooks 24 will engage loops 23 to hold the strips in secure but temporary engagement. Connector strips well suited for the present invention are sold under the trademark VELCRO. It is to be understood that the connectors described herein may be made of any suitable flexible material and the the term "plastic" is used to denote a material having a certain degree of flexibility. It is to be understood that connector strips 21 and 22 are reversible, it only being necessary that they engage one another. Also disposed on the outer surface of strap 20 is a Velcro pad 27 which is engageable with a mating pad disposed on the outer surface of bottle strap 30, as will here-in-after by explained. Strap 20 may include a flexible flange portion 28 to permit a pad 27 of comparatively large size. Flange 28 is preferably unitary with the longitudinal section of the strap. In the preferred embodiment, strap 20 is 4' 4" in length and 1 ¾" in width along the longitudinal portion. Flange 28 is cut, inserted, or otherwise attached to the longitudinal portion approximately one foot from the end of the strap having connector 21, as shown in FIG. 3. Flange 28, at its intersection with the main portion, is 6" in width. The balance of the strap, carrying connector strip 22 is 2' 10" in length. Straps of longer or shorter lengths, of course, may be made to suit the preference of the individual. Velcro connector strip 21 is approximately 10" in length and Velcro strip 22 is approximately 13" in length in the preferred embodiment. Velcro pad 27 may have a width of approximately 2" and a length of 4".

Figure 5:
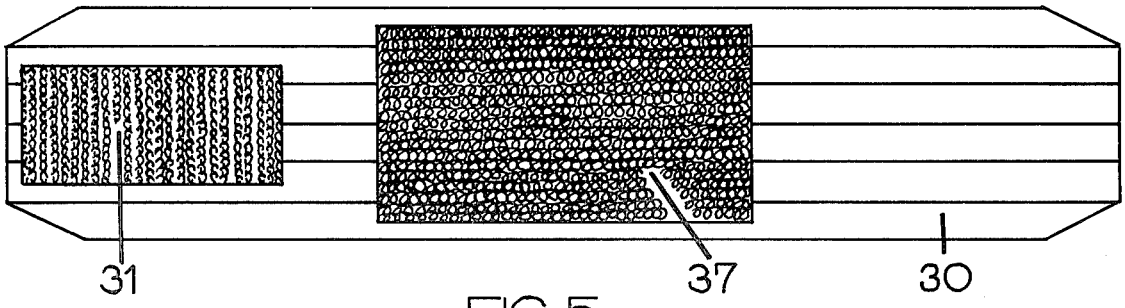
FIG. 5 is a front view of the bottle holder strap of the present invention.
Figure 6:
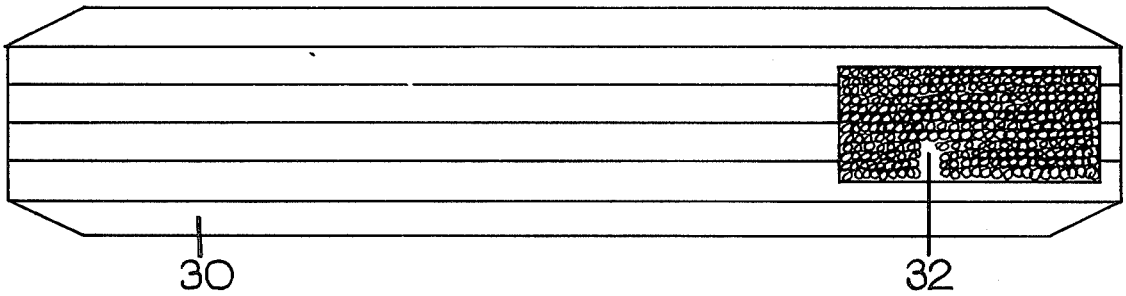
FIG. 6 is a back view of the bottle holder strap of the present invention.

Bottle strap 30, shown to advantage in FIGS. 5 and 6 may be made of any suitable fabric; a fabric having some degree of elasticity being preferred. The strap, in unstretched condition, is preferably 8 to 9 inches in length and 1 ¾" in width. Disposed on the outer surface of the strap is a Velcro connector strip 31 approximately 2" in length and ¾" in width and a Velcro pad 37 approximately 2" in length and 1½" in width. On the opposite side of strap 30 and at an end opposite connector strip 31 is a second Velcro strip, connector 32, which is temporarily engageable with connector strip 31 to surround bottle 40, as shown in FIG. 1, to form a clamp about the bottle. Velcro pad 37 engages Velcro pad 27 to hold bottle 40 in position. It is unimportant which of the pads, 27 or 37 contain the loops and which of the pads contain the hooks, it being important only that they securely and temporarily engage one another.

Figure 7:
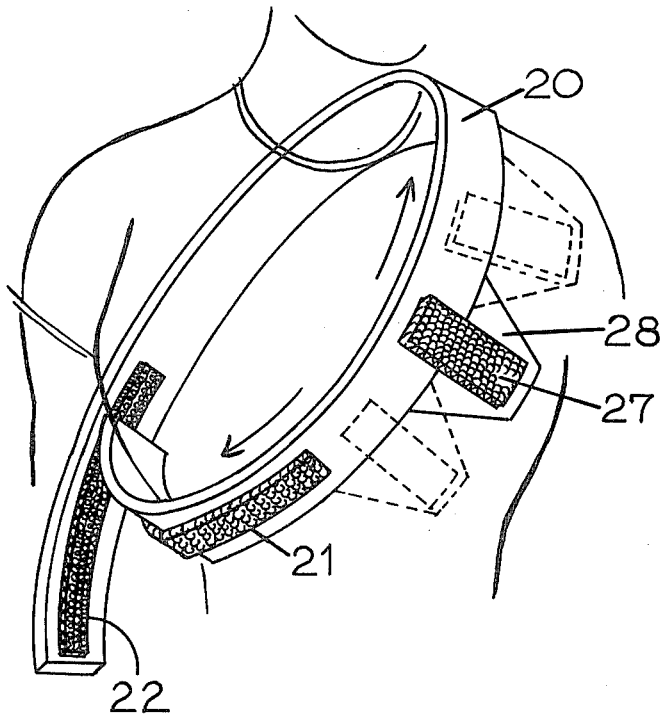
FIG. 7 is a perspective view of the nursing bottle holder of the present invention showing proper positioning and adjustment of the shoulder strap about the person.
Figure 8:
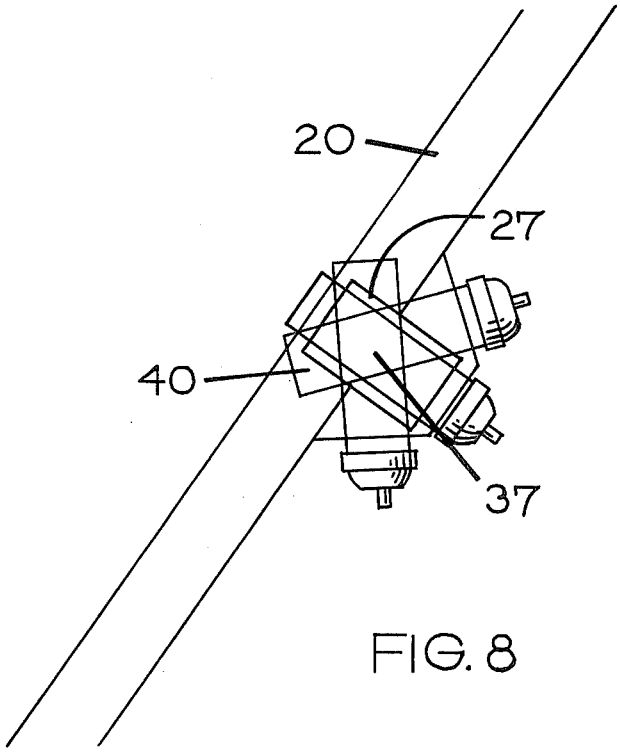
FIG. 8 is a fragmentary view of a nursing bottle holder of the present invention showing possible rotation positions of the bottle.

In operation, shoulder strap 20 is placed around either shoulder with the inner surface of the strap contacting the wearer. Once a loop of comfortable size is obtained, connector strip 21 is pressed into engagement with connector strip 22 to retain the loop in the size selected. The strap 20, now in the form of a loop, may be obliquely rotated, as shown to advantage in FIG. 7, about the shoulder and waist of the person to obtain a desired height on the bottle to be held. Bottle strap 30 is then stretched about the circumference of of the baby bottle with the inner surface of the strap contacting the bottle. Connector strips 31 and 32 are then pressed together to secure the strap about the bottle. Bottle 40 with surrounding strap 30 is then pressed against shoulder strap 20 with Velcro pad 37 of bottle strap 30 engaging Velcro pad 27 of shoulder strap 20. It will be seen, as shown to advantage in FIG. 8, that bottle 40 may be tilted or rotated to a selected vertically planar position for feeding the infant. Should rotation of the bottle be desired, the bottle with bottle strap 30 is simply removed from shoulder strap 20 and re-pressed onto the shoulder strap until a desired position is obtained. After feeding, the bottle, together with bottle strap 30 may be conveniently removed and the baby may be held with the shoulder strap still in place without fear of injury to the infant.

Having thus described in detail a preferred embodiment of the present invention it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

We claim:

1. A nursing bottle holder comprising:

an elongated flexible shoulder strap having an inner surface and an outer surface and adapted to obliquely encircle a shoulder and waist of a person, said strap including a pliable pad vertically disposed on the outer surface thereof, said pad having a multiplicity of plastic connectors thereon; and an elongated flexible bottle strap having an inner surface and an outer surface and adapted to engage and clampingly encircle a nursing bottle, said bottle strap including a pliable pad vertically and immovably disposed on the outer surface thereof, said pad having a multiplicity of plastic connectors thereon, the connectors operable to universally and temporarily engage the connectors of the shoulder strap pad to hold the nursing bottle in a selected vertically planar position.

2. A nursing bottle holder as described in claim 1, wherein said shoulder strap is provided with a pair of connector strips disposed on opposing ends and surfaces thereof, each of said connector strips having a multiplicity of plastic connectors thereon, the connectors of each strip operable to temporarily and securely engage one another to provide a shoulder strap of selected length.

3. A nursing bottle holder as described in claim 1, wherein said bottle strap is provided with a pair of connector strips disposed on opposing ends and surfaces thereof, each of said connector strips having a multiplicity of plastic connectors thereon, the connectors of each strip operable to temporarily and securely engage one another to provide a bottle strap of adjustable diameter.

4. A nursing bottle holder comprising:

an elongated flexible waist strap having an inner surface and an outer surface and adapted to obliquely encircle a shoulder and waist of a person, said strap including a pliable pad vertically disposed on the outer surface thereof, said pad having a multiplicity of plastic connectors thereon, and said strap provided with a pair of connector strips disposed on opposing ends and surfaces thereof, each of said connector strips having a multiplicity of plastic connectors thereon, the connectors of each strip operable to temporarily and securely engage one another to provide a waist strap of selected size; and an elongated flexible bottle strap having an inner surface and an outer surface and adapted to engage and encircle a nursing bottle, said bottle strap including a pliable pad vertically disposed on the outer surface thereof, said pad having a multiplicity of plastic connectors thereon, the connectors operable to universally and temporarily engage the connectors of the waist strap pad to hold the nursing bottle in a selected vertically planar position, and said bottle strap provided with a pair of connector strips disposed on opposing ends and surfaces thereof, each of said connector strips having a multiplicity of plastic connectors thereon, the connectors of each strip operable to temporarily and securely engage one another to provide a bottle strap of adjustable diameter.

* * * * *